US010870944B2

(12) United States Patent
Smoots

(10) Patent No.: US 10,870,944 B2
(45) Date of Patent: Dec. 22, 2020

(54) GLOVE AND MITTEN DRYER

(71) Applicant: Karen Smoots, Portage, MI (US)

(72) Inventor: Karen Smoots, Portage, MI (US)

( * ) Notice: Subject to any disclaimer, the term of this patent is extended or adjusted under 35 U.S.C. 154(b) by 130 days.

(21) Appl. No.: 16/185,449

(22) Filed: Nov. 9, 2018

(65) Prior Publication Data

US 2019/0078253 A1 Mar. 14, 2019

Related U.S. Application Data

(60) Division of application No. 15/846,632, filed on Dec. 19, 2017, now abandoned, which is a continuation-in-part of application No. 14/590,791, filed on Jan. 6, 2015, now Pat. No. 9,856,597.

(60) Provisional application No. 62/057,891, filed on Sep. 30, 2014.

(51) Int. Cl.
*D06F 59/04* (2006.01)
*F26B 21/00* (2006.01)

(52) U.S. Cl.
CPC ..... *D06F 59/04* (2013.01); *F26B 21/001* (2013.01); *F26B 21/008* (2013.01)

(58) Field of Classification Search
CPC ..... F25B 21/04; F25B 21/008; F25B 21/006; D06F 58/10; F16L 37/025; Y10T 29/4994; Y10T 24/3973; Y10T 29/49858; Y10T 29/49872; H04R 1/025; B60R 1/04; A47L 23/20; A47L 23/205; A43D 3/1491; F26B 9/003; B65D 77/003; B65D 85/62
USPC ..... 34/104; 403/52, 83, 90; 206/499, 500, 206/505
See application file for complete search history.

(56) References Cited

U.S. PATENT DOCUMENTS 208,070 A * 9/1878 Buxton ..... F26B 21/006 34/104
1,450,033 A * 3/1923 Gowan ..... D06F 59/00 34/104
2,465,362 A * 3/1949 Elliott ..... A47L 23/20 34/104
2,912,741 A * 11/1959 Bennett ..... F27D 99/0033 264/607
3,413,021 A * 11/1968 Potts ..... F16L 37/025 285/319
4,085,519 A * 4/1978 Masika ..... A47L 23/20 223/66
4,132,047 A * 1/1979 Gerigk ..... A22C 13/0003 138/118.1

(Continued)

*Primary Examiner* — Edelmira Bosques
*Assistant Examiner* — Bao D Nguyen
(74) *Attorney, Agent, or Firm* — Jacob M. Ward; Ward Law Office LLC

(57) ABSTRACT

A drying system embodying a method and glove dryer mountable to an outlet of an already-running furnace when in use so as to safely and efficiently dry out articles, and that dissembles into stackable elements when stored is provided. The glove dryer may include a base providing a plurality of detachable nozzles. The base may form a volumetric enclosure for both safely mounting the outlet of an already-running furnace as well as for storage purposes. The plurality of detachable nozzles may be stacked in a nest configuration when removed from the base for storing in the volumetric enclosure. When in use, the plurality of detachable nozzles each provide a plurality of holes through which heated air from the outlet reaches to tops of articles of clothing slidably received thereon.

13 Claims, 8 Drawing Sheets

(56) References Cited

U.S. PATENT DOCUMENTS 4,136,464 A * 1/1979 Hay ..... A47L 23/20 239/274
4,200,993 A * 5/1980 Blanc ..... A43D 3/1491 211/34
4,398,633 A * 8/1983 Weinstein ..... B65D 85/62 206/436
4,435,031 A * 3/1984 Black ..... H01R 12/7029 174/138 D
4,596,078 A * 6/1986 McCartney ..... A47L 23/205 34/103
D293,021 S * 12/1987 McCartney ..... D23/314
4,981,651 A * 1/1991 Horng ..... A43D 3/1491 250/455.11
5,117,565 A * 6/1992 Willenbacher, Jr. .... D06F 59/04 223/78
5,178,280 A * 1/1993 Ohlsson ..... B65D 3/06 206/431
5,199,188 A * 4/1993 Franz ..... A47L 23/205 34/104
D347,094 S * 5/1994 Christensen, Jr. ..... D32/58
5,394,619 A * 3/1995 Kaplan ..... D06F 57/127 34/104
5,406,717 A * 4/1995 Dofka ..... D06F 59/04 211/37
5,412,928 A * 5/1995 Reithel ..... A47L 23/205 34/104
D372,346 S * 7/1996 Marks ..... D32/8
5,592,750 A * 1/1997 Eichten ..... D06F 59/02 223/70
5,604,993 A * 2/1997 Auckerman ..... D06F 59/04 219/211
5,632,099 A * 5/1997 Seifert ..... A47L 23/205 34/106
5,634,429 A * 6/1997 Loomis ..... A01K 5/0225 119/52.2
5,692,316 A * 12/1997 Antal ..... A47L 23/205 34/106
5,946,814 A * 9/1999 Farrant ..... A47L 23/205 34/103
6,216,359 B1 * 4/2001 Peet ..... A47L 23/205 34/105
6,327,792 B1 * 12/2001 Hebert ..... A43D 3/1491 34/104
6,722,011 B1 * 4/2004 Bacon ..... B23P 19/084 29/222
6,880,711 B2 * 4/2005 Collier ..... A47G 25/0671 211/85.3
D541,493 S * 4/2007 Peet ..... D32/8
7,430,816 B1 * 10/2008 Lozenski ..... A47L 23/205 34/104
D616,537 S * 5/2010 Gosko-Sadowski ..... D23/393
D648,091 S * 11/2011 Southwick ..... D32/58
D665,549 S * 8/2012 Kropf ..... D32/58
8,857,072 B1 * 10/2014 Cocker ..... F26B 9/003 34/104
2004/0052575 A1 * 3/2004 Draggoo ..... F16B 21/082 403/298
2004/0181963 A1 * 9/2004 Morris ..... D06F 59/04 34/103
2005/0047850 A1 * 3/2005 Wright ..... H04R 1/025 403/90
2005/0050754 A1 * 3/2005 Deblois ..... D06F 59/04 34/218
2006/0130997 A1 * 6/2006 Marshall ..... F26B 9/003 165/41
2006/0180566 A1 * 8/2006 Mataya ..... A61J 7/04 215/230
2007/0199852 A1 * 8/2007 Rutledge ..... B65D 85/62 206/508
2008/0149007 A1 * 6/2008 MacLean ..... F16B 12/2027 108/155
2010/0031526 A1 * 2/2010 Tuckett ..... D06F 58/10 34/60
2013/0160317 A1 * 6/2013 Stumpo ..... F26B 25/00 34/239
2013/0212900 A1 * 8/2013 Stewart ..... F26B 9/003 34/275
2014/0338212 A1 * 11/2014 Williams ..... F26B 21/004 34/104
2018/0105972 A1 * 4/2018 Smoots ..... F26B 21/008

* cited by examiner

GLOVE AND MITTEN DRYER

CROSS-REFERENCE TO RELATED APPLICATIONS

This application is a divisional of U.S. patent application Ser. No. 15/846,632, filed on Dec. 19, 2017, which in turn is continuation-in-part of U.S. patent application Ser. No. 14/590,791, filed on Jan. 6, 2015, and issued as U.S. Pat. No. 9,856,597 on Jan. 2, 2018, which in turn claims the benefit of U.S. Provisional Application No. 62/057,891, filed on Sep. 30, 2014. The entire disclosures of the above applications are hereby incorporated herein by reference.

BACKGROUND OF THE INVENTION

The present invention relates to dryer devices and, more particularly, to a device mountable to an outlet of a furnace when in use so as to dry out articles, and that dissembles into stackable elements when stored.

Gloves, mittens, shoes and other articles of clothing are difficult to dry on the inside when sweat and moisture from snow, rain and perspiration saturate them. As such, this moisture and sweat cause foul odor and wet and cold extremities. Drying such articles is a costly process when utilizing gas or electric dryers as gloves, mittens and outdoor articles are designed to keep water from entering, and so when saturated they can take enormous amounts of energy to dry using the current systems. Current dryer systems for such articles not only require lengthy dry time and added electricity costs, they are also not portable or easily storable, and may be fire hazards if too makeshift.

As can be seen, there is a need for a device mountable to an outlet of an already-running furnace when in use so as to safely and efficiently dry out articles, and that dissembles into stackable elements when stored. There is a continuing need in the art for a means of utilizing the sides of a sawhorse to provide a storage spaced. Desirably, the means permits for storage of many different types of tools and supplies.

SUMMARY OF THE INVENTION

In one aspect of the present invention, a glove dryer for use with a preexisting furnace comprises: a base forming a volumetric enclosure for substantially enclosing an outlet of the preexisting furnace; a plurality of base holes provided by the base; and a plurality of tubular detachable nozzles, each comprising: a connecting end, wherein the connecting end is configured to removably attach to any one of the plurality of base holes; an opposing distal end, wherein the distal end forms a exit hole; and a plurality of auxiliary holes disposed between the connecting end and the distal end.

In another aspect of the present invention, a glove dryer for use with a preexisting furnace comprises: a base forming a volumetric enclosure for substantially enclosing an outlet of the preexisting furnace, wherein the volumetric enclosure is defined in part by a planar periphery, and a plurality of base holes provided by the base, wherein the plurality of base holes are arranged in a non-normal orientation with respect to the planar periphery; and a plurality of tubular detachable nozzles, each comprising: a connecting end, wherein the connecting end is configured to removably attach to any one of the plurality of base holes; an opposing distal end, wherein the distal end forms a exit hole; and a plurality of auxiliary holes disposed between the connecting end and the distal end, wherein each detachable nozzle tapers toward the distal end, wherein the plurality of detachable nozzles are dimensioned and configured to stack in a nested configuration, and wherein the volumetric enclosure is dimensioned to receive at least one nested configuration therein.

In a further aspect of the present invention, a glove dryer for use with a preexisting furnace includes a base with a stepped shape and a plurality of tubular detachable nozzles. The base has a planar periphery and forms a volumetric enclosure configured to enclose an outlet of the preexisting furnace. In particular, the base has a first platform that is spaced apart from a second platform. A plurality of base holes are formed in the first platform and the second platform of the base. The plurality of tubular detachable nozzles are removably received by the base holes.

In yet another aspect, a kit for a glove dryer configured to be used with a preexisting furnace, includes a base, a plurality of tubular detachable nozzles, and a pair of wall clips. The base as a stepped shape and a planar periphery, and forms a volumetric enclosure configured to enclose an outlet of the preexisting furnace. The base has a first platform that is spaced apart from a second platform. A plurality of base holes are provided by the first platform and the second platform of the base. The plurality of tubular detachable nozzles are configured to be removably received by the base holes. The pair of wall clips are configured to removably hold the base over an air register disposed on a wall of a building.

In an additional aspect, a glove dryer for use with a preexisting furnace includes a base, and a plurality of frustoconical tubular detachable nozzles. The base has at least one wall and a planar periphery forming a volumetric enclosure configured to enclose an outlet of the preexisting furnace. A plurality of base holes are formed in the at least one wall of the base. Each of the holes has opposing planar surfaces. Each of the plurality of frustoconical tubular detachable nozzles has a connecting end, an opposing distal end, a plurality of auxiliary holes a stop rim, at least two guide rims, and at least two set-back clip portions. The connecting end is configured to removably attach to one of the plurality of base holes. Each nozzle tapers from the connecting end toward the distal end. The plurality of auxiliary holes are disposed between the connecting end and the distal end. The stop rim is disposed along a periphery of the nozzle axially inwardly from the connecting end. The stop rim is defined by a continuous ring disposed around the periphery. The at least two guide rims and at least two set-back clip portions are spaced apart and alternating in an annular arrangement radially inwardly from the stop rim, and disposed between the stop rim and the connecting end. A wall-receiving gap is defined by a distance between an underside of the stop rim and the planar surface of each of the nozzle lock portions. The distance is equal to a thickness of the wall of the base adjacent to the one of the plurality of base holes. The wall-receiving gap is configured to securely receive the wall of the base to removably lock the connecting end to the one of the plurality of base holes. Advantageously, the opposing planar surfaces of the base hole cooperate with the set-back clip portions to permit an insertion of the one of the plurality of base holes.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a drying system embodying a method and glove dryer mountable to an outlet of an already-running furnace when in use so as to safely and efficiently dry out articles, and that dissembles into stackable elements when stored. The glove dryer may include a base providing a plurality of detachable nozzles. The base may form a volumetric enclosure for both safely mounting the outlet of an already-running furnace as well as for storage purposes. The plurality of detachable nozzles may be stacked in a nest configuration when removed from the base for storing in the volumetric enclosure. When in use, the plurality of detachable nozzles each provide a plurality of holes through which heated air from the outlet reaches to tops of articles of clothing slidably received thereon.

Referring to FIGS. 1 through 10, the present invention may include a drying system embodying a method and a glove dryer 50 mountable to an outlet of an already-running furnace so as to safely and efficiently dry out articles when in use, and that dissembles into stackable elements when stored. The glove dryer 50 may include a base 10 and a plurality of detachable nozzles 14.

Figure 1:
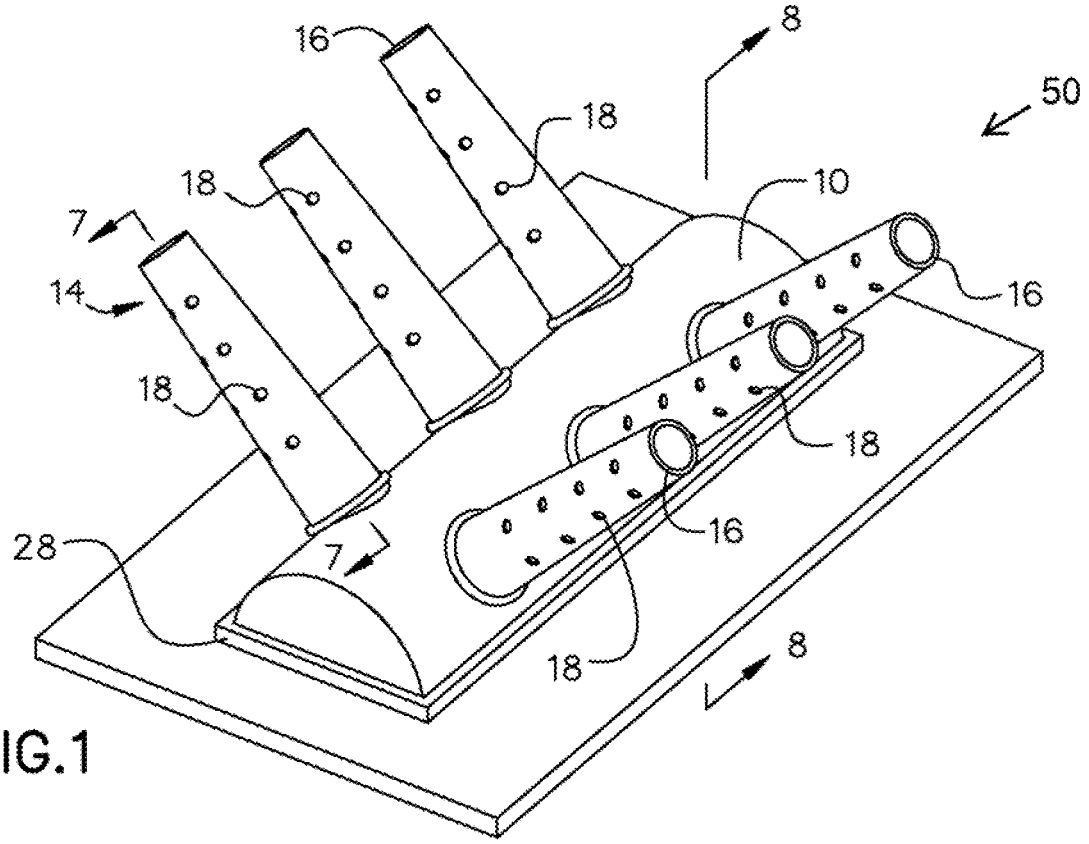
FIG. 1 is a perspective view of an exemplary embodiment of the present invention.

The base 10 may be substantially half-cylindrical shaped or may be configured in any volumetric shape so long as the base 10 function in accordance with the present invention as described herein. The half-cylindrical shape may be adapted to form a volumetric enclosure over an air register 28 so that the base 10 is not substantially resting directly on the air register 28 so as to mitigate overheating of the base 10 or otherwise stifling of the air register 28. In certain embodiments, the volumetric enclosure may be defined in part by a planar periphery 40 for circumscribing the air register 28. The air register 28 may be a vent, a collection of vanes or the like that act to control the output of an outlet of a furnace. The volumetric shape of the base 10 may also facilitate sufficient spacing of the plurality of detachable nozzles 14, as illustrated in FIG. 1. The volumetric shape of the base 10 also enables the storage of the glove dryer 50 as discussed later.

The base 10 may have a plurality of base holes 12 arranged so as to facilitate sufficient spacing of the plurality of detachable nozzles 14. Each base hole 12 may be adapted to removably attach to a connecting end 34 of each detachable nozzle 14.

The detachable nozzle 14 may be a tapered tube that extends from the connecting end 34 to an opposing distal end terminating in an exit hole 16. The tapering shape of the detachable nozzle 14 facilitates slidably securing articles 30 onto the distal end thereof, as illustrate in FIG. 8. In certain embodiments, the volumetric shape of the base 10 has base holes 12 oriented at angles to support similarly-oriented nozzles 14 so that the article 30 can more readily rest thereon. In certain embodiments, the plurality of base holes may be arranged in a non-normal orientation with respect to the planar periphery 40 of the base 10. A plurality of auxiliary holes 18 may be arranged in a suitable manner on each detachable nozzle 14 between the connecting end 34 and the exit hole 16.

Figure 7:
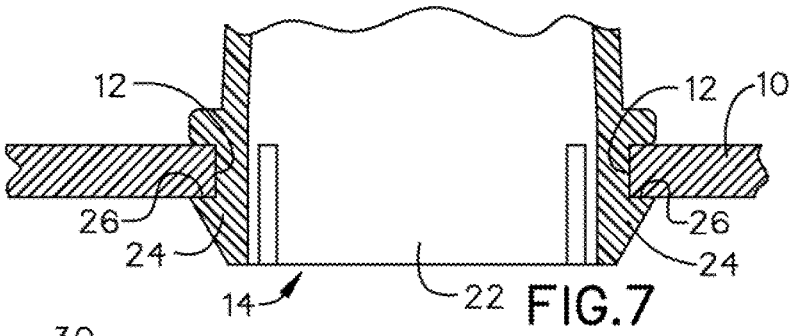
FIG. 7 is a detail section view of an exemplary embodiment of the present invention, taken along line 7-7 in FIG. 1.
Figure 8:
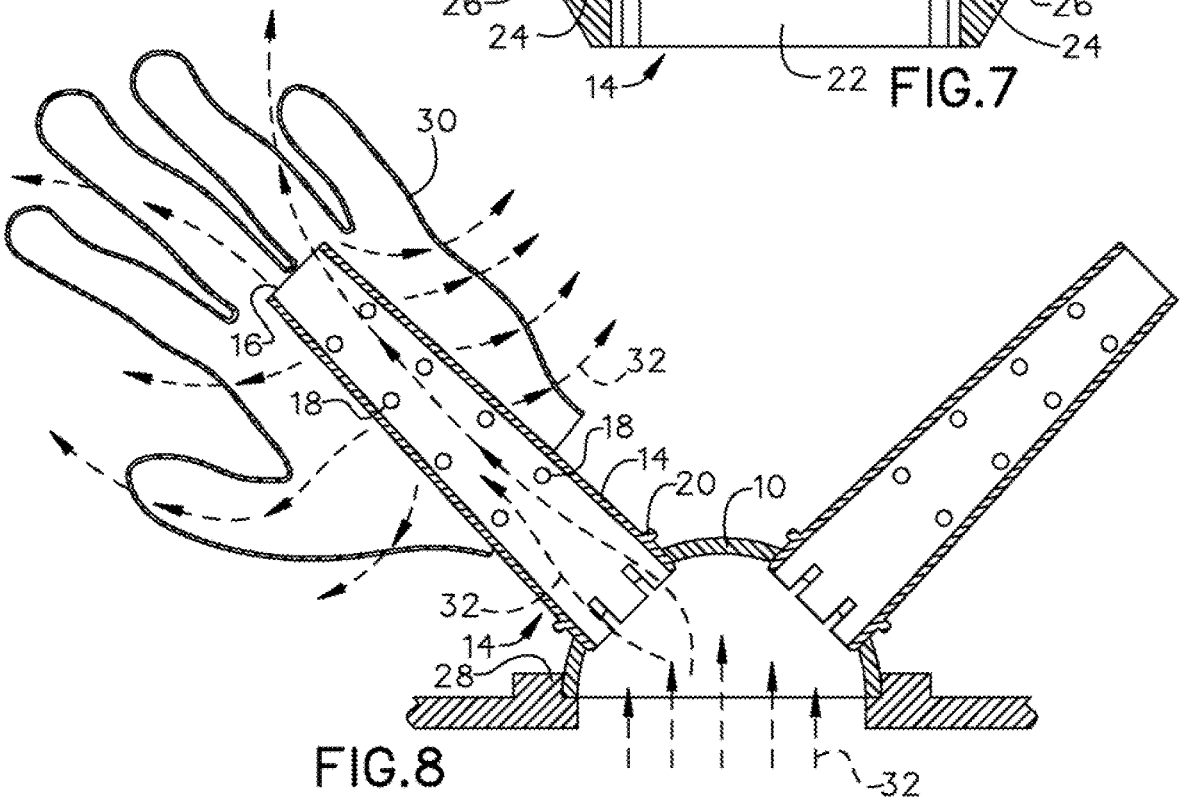
FIG. 8 is a section view of an exemplary embodiment of the present invention, taken along line 8-8 in FIG. 1, shown in use.
Figure 9:
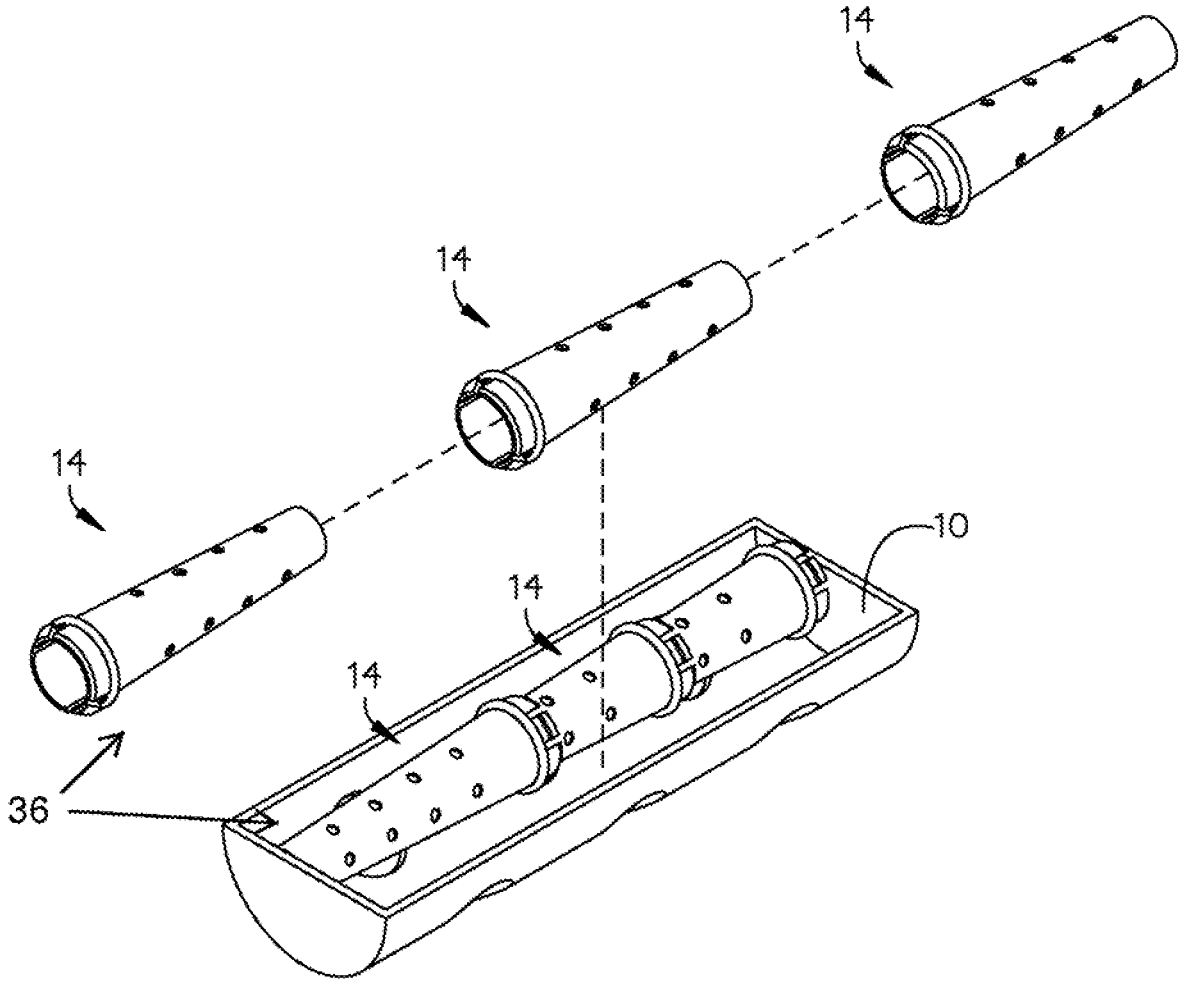
FIG. 9 is an exploded view of an exemplary embodiment of the present invention, demonstrating storage.
Figure 10:
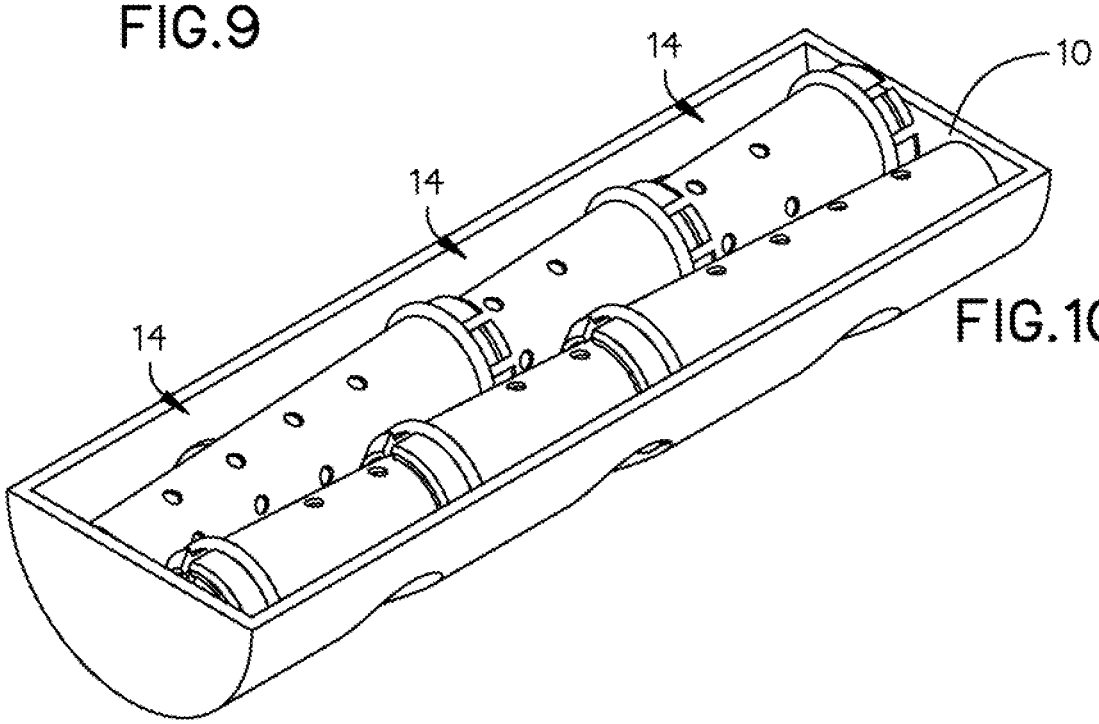
FIG. 10 is a perspective view of an exemplary embodiment of the present invention, demonstrating storage.

Each connecting end 34 may be dimensioned and adapted to be removably attached to a base hole 12. Each connecting end 34 may provide a stop rim 20 along a periphery of and inward from the connecting end 34. Each connecting end 34 may provide at least one guide rim 22 and at least one nozzle lock portion 24. Each nozzle locking portion 24 may provide a set-back clip portion 26 for removably locking the connecting end 22 to a periphery of a cooperating base hole 12, as illustrated in FIG. 7.

Each detachable nozzle 14 is stackable because of its tapered shape. In certain embodiments, the entire plurality of the detachable nozzle 14 may be stacked into at least one nested configuration 36 capable of being received by the volumetric enclosure of the base 10 for storage.

Figure 2:
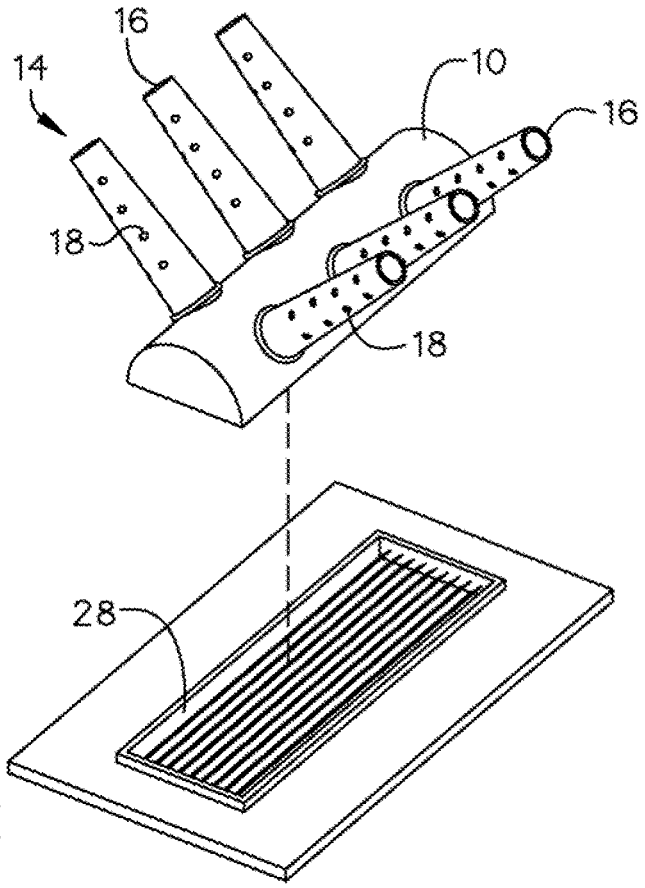
FIG. 2 is an exploded view of an exemplary embodiment of the present invention, shown in use.
Figure 3:
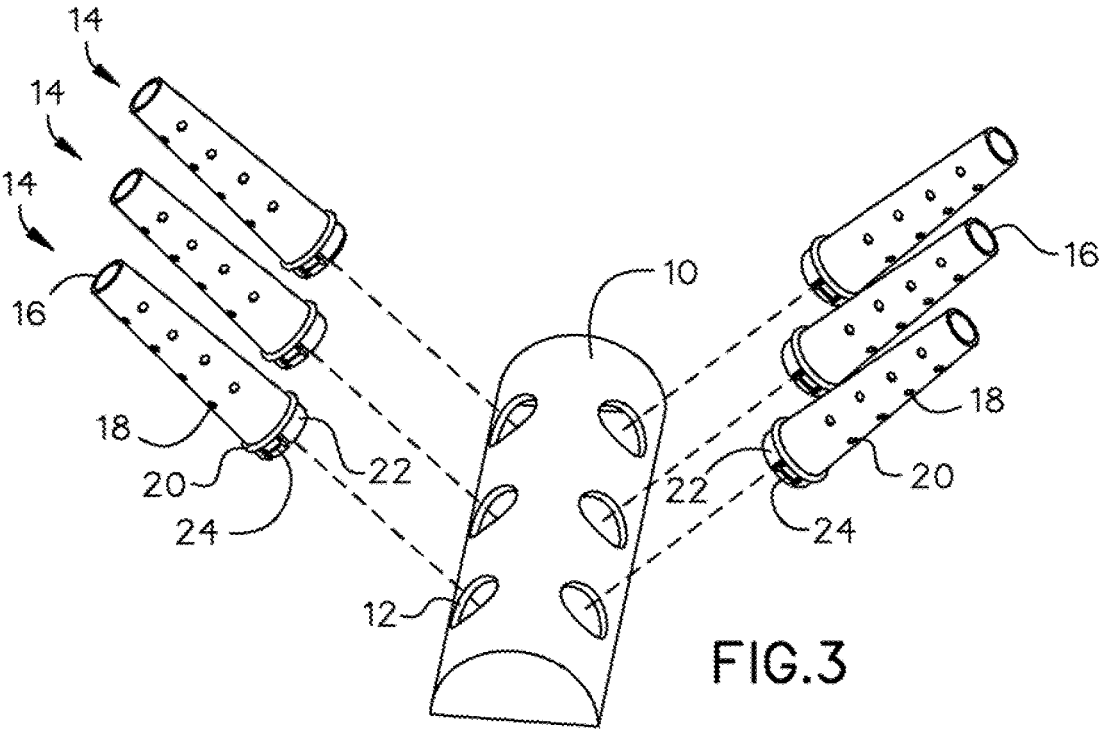
FIG. 3 is an exploded view of an exemplary embodiment of the present invention.
Figure 4:
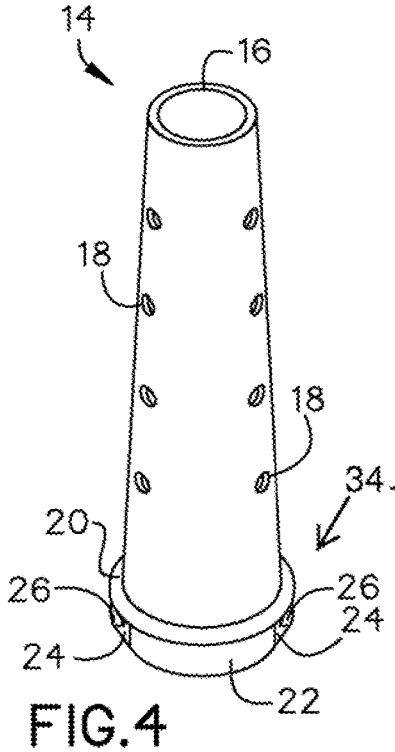
FIG. 4 is a top perspective view of an exemplary embodiment of the present invention.
Figure 5:
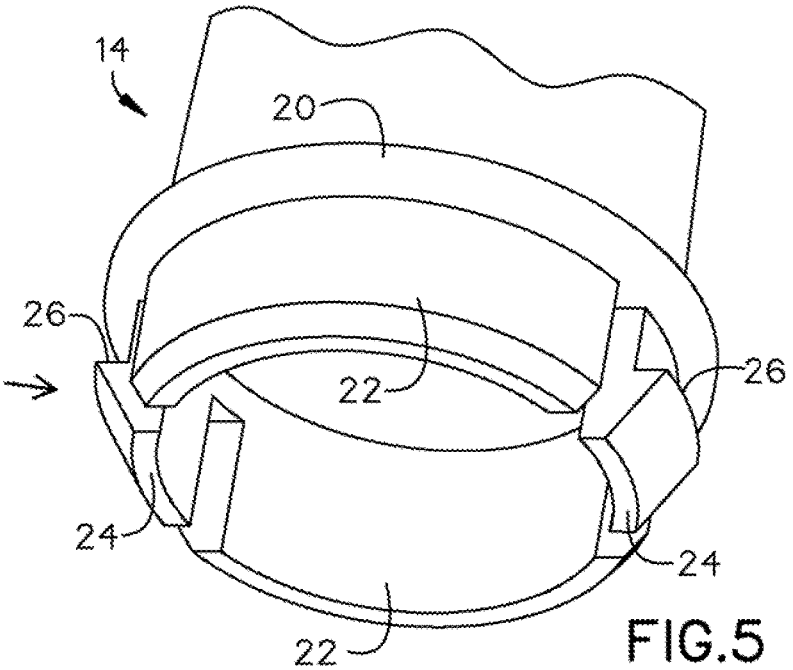
FIG. 5 is a bottom detail perspective view of an exemplary embodiment of the present invention.
Figure 6:
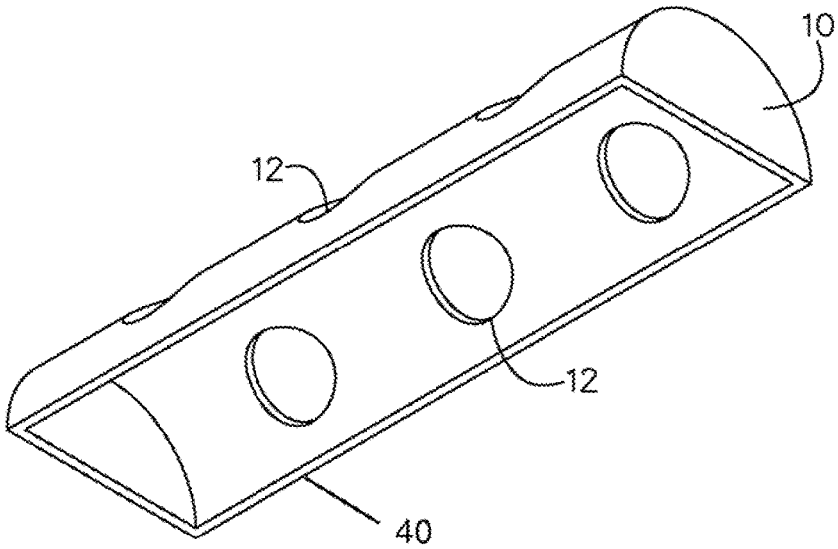
FIG. 6 is a bottom perspective view of an exemplary embodiment of the present invention.

A method of using the present invention may include the following. The glove dryer 50 disclosed above may be provided. A user may operably mount the base 10 over the air register 28, as illustrated in FIG. 2. Then the user may place a body-part-receiving opening of each article 30 over the distal end of a plurality of detachable nozzles 14, thereby allowing the heated air 32 through the plurality of auxiliary holes 18 and the exit hole 16 so as to reach to tops of the articles 30.

Subsequent use, the user may remove the plurality of detachable nozzles 14 and stack them into at least one nested configuration 36 for storing in the volumetric enclosure of the base 10 for later use.

A further embodiment of the drying system of the present invention is shown in FIGS. 11-14. For purpose of clarity, like or related structure to that shown in FIGS. 1-10 is identified with the same reference numbers in a 100-series in FIGS. 11-14. The drying system shown in FIGS. 11-14 is particularly configured for use with an air register 128 or vent on a wall of a building, in contrast to the floor-based drying system shown in FIGS. 1-10.

FIG. 1 shows a glove dryer 150 mountable to the wall outlet 128 of an already-running furnace so as to safely and efficiently dry out articles when in use, and that dissembles into stackable elements when stored. The glove dryer 150 may include a base 110 and a plurality of detachable nozzles 114.

The base 110 may have a substantially stepped shape, or may be configured in any volumetric shape so long as the base 110 functions in accordance with the present invention as described herein. The stepped shape may be adapted to form a volumetric enclosure over the wall-based air register 128 so that the base 110.

Figure 11:
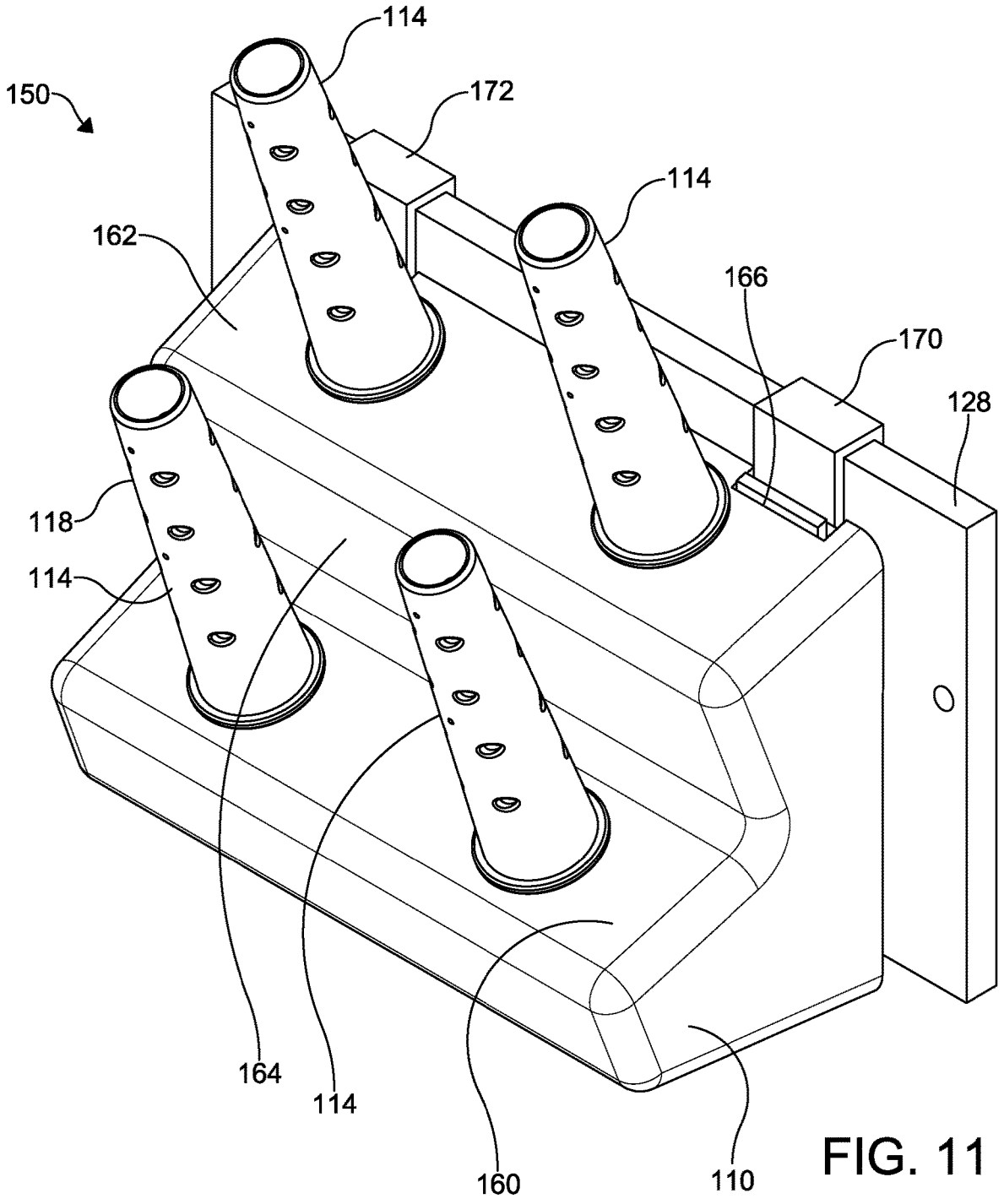
FIG. 11 is a front perspective view of a further exemplary embodiment of the present invention, shown in use.
Figure 12:
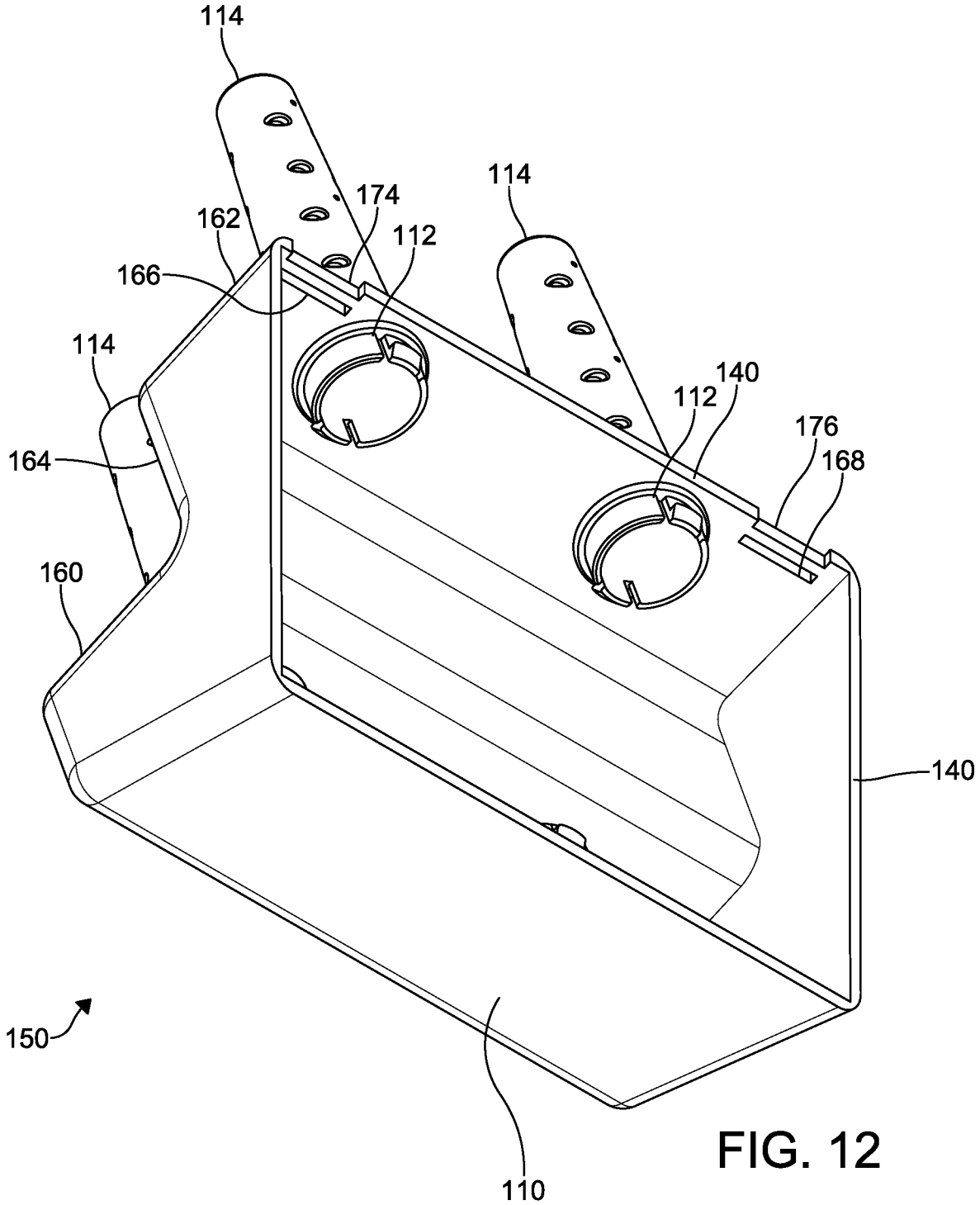
FIG. 12 is a rear perspective view of the further exemplary embodiment of the present invention.

In certain embodiments, the volumetric enclosure may be defined in part by a planar periphery 140 for circumscribing the wall-based air register 128. The air register 128 may be a vent, a collection of vanes or the like that act to control the output of an outlet of a furnace. The volumetric shape of the base 110 may also facilitate sufficient spacing of the plurality of detachable nozzles 114, as illustrated in FIGS. 11-12. The volumetric shape of the base 110 also enables the storage of the glove dryer 150 as discussed later.

Figure 13:
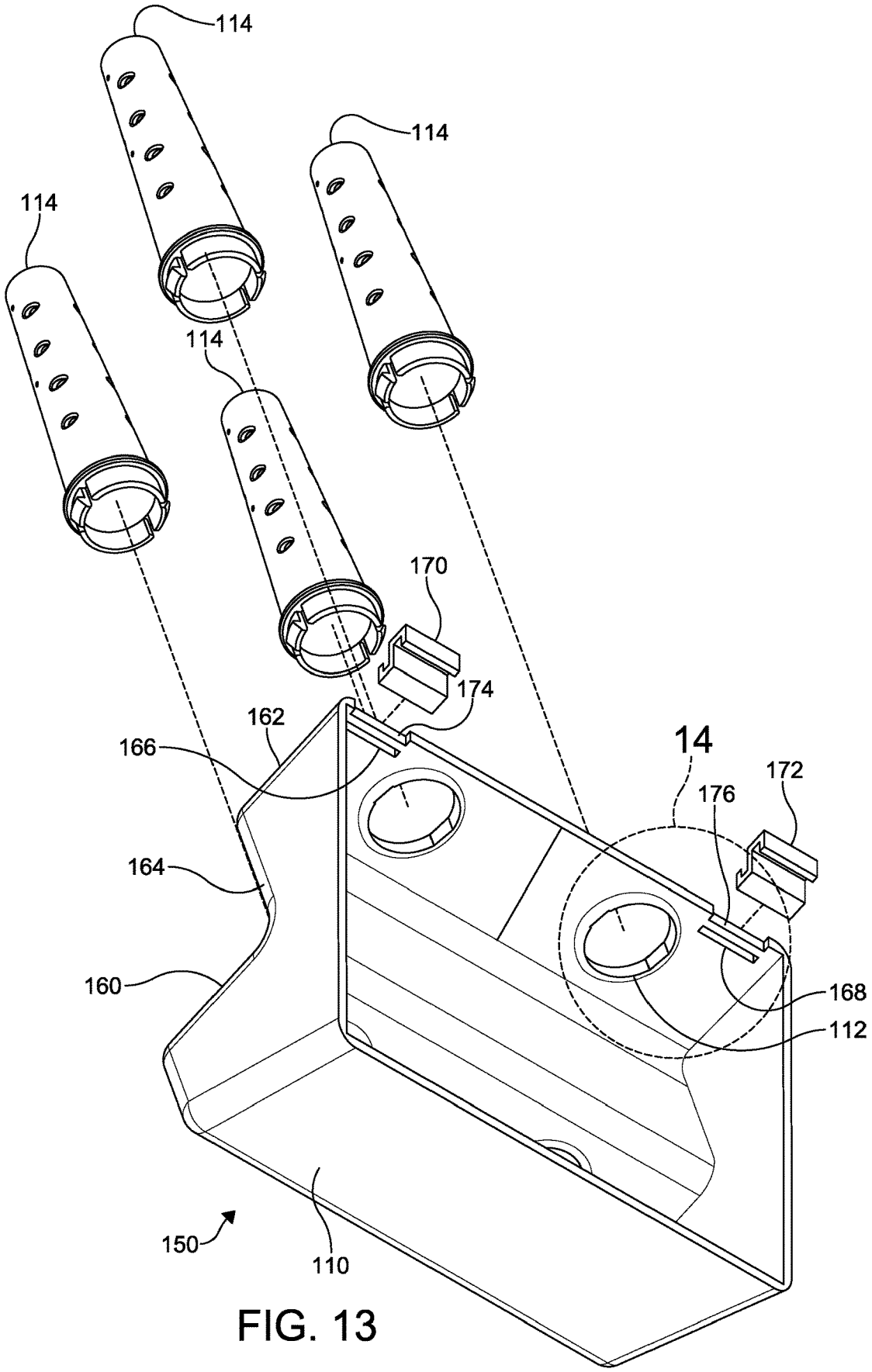
FIG. 13 is an exploded view of the further exemplary embodiment of the present invention.

In particular embodiments, as shown in FIG. 11-13, the stepped shape of the base 110 includes a first platform 160 and a second platform 162, both of which have the base holes 112 arranged so as to facilitate sufficient spacing of the plurality of detachable nozzles 114. The first platform 160 is spaced apart from the second platform 162, with the first platform 160 being disposed adjacent a bottom of the base 110 and the second platform 162 being disposed adjacent a top of the base 110. The first platform 160 may also be connected to the second platform 162 by a connecting wall 164. Each of the first platform 160 and the second platform 162 may be substantially planar walls that are oriented on planes that are transverse to a plane defined by the planar periphery 140 of the base.

As shown in FIGS. 11-13, the second platform 162 may have a pair of holes 166, 168 that are formed through the second platform 162 adjacent to the planar periphery 140. The holes 166, 168 are spaced apart from one another along a width of the base 110. The holes 166, 168 are removably receive wall clips 170, 172, which are in turn configured to attach to the air register 128 or vent on the wall and hold the base 110 over the air register 128 or vent, as shown in FIG. 11. In particular embodiments, the holes 166, 168 are elongate slots, and the wall clips 170, 172 are substantially S-shaped brackets. The wall clips 170, 172 may be formed from plastic or metal, as non-limiting examples. However, one of ordinary skill in the art may select other suitable shapes for the holes 166, 168, and shapes and materials for the clips 170, 172, as desired.

Figure 14:
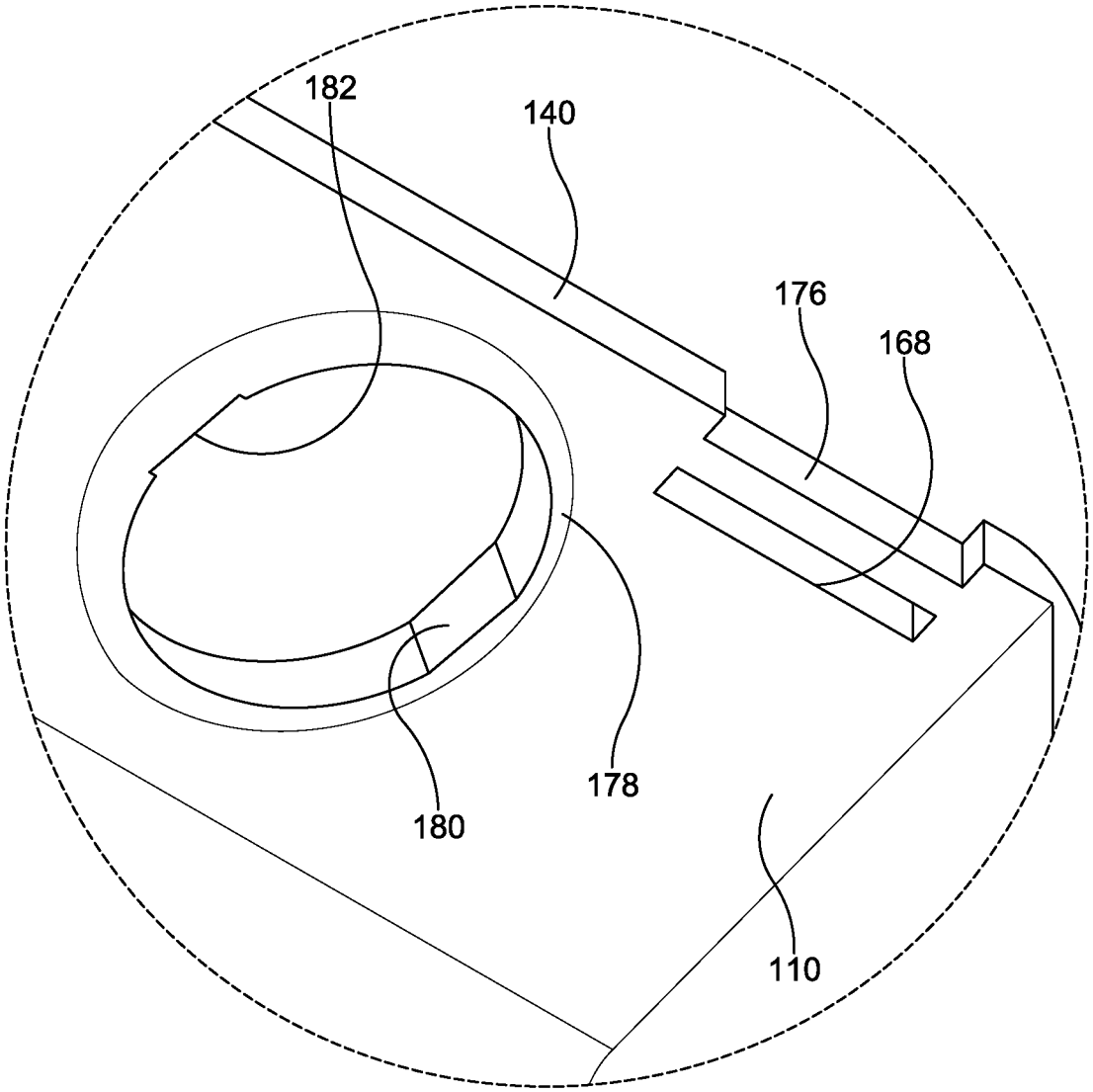
FIG. 14 is an enlarged view of the further exemplary embodiment of the present invention.

With reference to FIGS. 12-14, the planar periphery 140 may further have a pair of notches 174, 176 formed therein. Each of the notches 174, 176 may be disposed adjacent to one of the holes 166, 168 formed through the second platform 162. The notches 174, 176 may be sized to receive the wall clips 170, 172, so that when the wall clips 170, 172 are inserted into the holes 166, 168, portion of the wall clips 170, 172 are disposed within the notches 174, 176 and substantially flush with the adjacent portions of the planar periphery 140. In this manner, the wall clips 170, 172 do not interfere with an abutting and sealing of the planar periphery 140 to the area around the openings of the air register 128. This advantageously minimizes a venting of air from around the planar periphery 140 in operation.

As shown in FIG. 14, each of the base holes 112 may also have a raised annular ring 178 formed on an inner surface of the base 110 around the base hole 112. The thickness of the annular ring 178, together with the thickness of the platform 160, 162 on which it is formed, are substantially the same as a width of a wall-receiving gap that is defined by a distance between an underside of the stop rim 120 and the planar surface of each of the nozzle lock portions 124.

With further reference to FIG. 14, the annual ring 178 may further have a pair of opposing planar surfaces 180, 182. These planar surfaces 180, 182 permit the insertion and removal of the nozzle lock portions 124 of one of the nozzles 114 into the base hole 112 when the nozzle lock portions 124 are aligned with the planar surfaces 180, 182, for example, as shown in FIG. 13.

Upon twisting of the nozzles 114 following insertion, for example, as shown in FIG. 12, so that the nozzle lock portions 124 are not aligned with the planar surfaces 180, 182, the nozzles 114 are locked into the base holes 112. This militates against a removal of the nozzles 114 until twisted further to place the nozzle lock portions 124 back in alignment with the planar surfaces 180, 182. In this manner, the nozzles 114 may be secured more rigidly to the base 110.

It should be understood, of course, that the foregoing relates to exemplary embodiments of the invention and that modifications may be made without departing from the spirit and scope of the invention as set forth in the following claims.

What is claimed is:

1. A glove dryer for use with a preexisting furnace, the glove dryer comprising:

a base with a stepped shape and a planar periphery forming a volumetric enclosure configured to enclose an outlet of the preexisting furnace, the base having a first platform spaced apart from a second platform, and a plurality of base holes formed in the first platform and the second platform of the base;

a plurality of tubular detachable nozzles removably received the base holes;

wherein the second platform has a pair of holes that are formed through the second platform adjacent to the planar periphery and configured to receive removable wall clips;

wherein the planar periphery further has a pair of notches formed therein and configured to receive the removable wall clips; and wherein each of the notches is disposed adjacent to one of the base holes.

2. The glove dryer of claim 1, wherein each of the first platform and the second platform are planar walls that are oriented on planes that are transverse to a plane defined by the planar periphery of the base.

3. The glove dryer of claim 1, wherein the base holes are spaced apart from one another along a width of the base.

4. The glove dryer of claim 3, wherein the base holes are elongate slots.

5. The glove dryer of claim 1, wherein each of the base holes has a raised annular ring formed on an inner surface of the base around the base hole, the annular ring having a pair of opposing planar surfaces configured to permit an insertion of the tubular detachable nozzles.

6. The glove dryer of claim 5, wherein a thickness of the annular ring together with a thickness of the first platform or the second platform on which the annular ring is formed together is the same as a width of a wall-receiving gap of each of the plurality of tubular detachable nozzles.

7. The glove dryer of claim 6, wherein the width of the wall-receiving gap is defined by a distance between an underside of a stop rim and a planar surface of a nozzle lock portion of each of the plurality of tubular detachable nozzles.

8. A kit for a glove dryer configured to be used with a preexisting furnace, the kit comprising:

a base with a stepped shape and a planar periphery forming a volumetric enclosure configured to enclose an outlet of the preexisting furnace, the base having a first platform spaced apart from a second platform, and a plurality of base holes provided by the first platform and the second platform of the base;

a plurality of tubular detachable nozzles configured to be removably received by the base holes;

a pair of removable wall clips configured to hold the base over an air register disposed on a wall of a building;

wherein the second platform has a pair of holes that are formed through the second platform adjacent to the planar periphery and configured to receive the removable wall clips;

wherein the base holes are spaced apart from one another along a width of the base; and wherein the base holes are elongate slots.

9. The kit of claim 8, wherein each of the first platform and the second platform are planar walls that are oriented on planes that are transverse to a plane defined by the planar periphery of the base.

10. The kit of claim 8, wherein the planar periphery further has a pair of notches formed therein and configured to receive the removable wall clips.

11. The kit of claim 10, wherein each of the notches is disposed adjacent to one of the base holes.

12. The kit of claim 8, wherein each of the base holes has a raised annular ring formed on an inner surface of the base around the base hole, the annular ring having a pair of opposing planar surfaces configured to permit an insertion of the tubular detachable nozzles.

13. The kit of claim 12, wherein a thickness of the annular ring together with a thickness of the first platform or the second platform on which the annular ring is formed together is the same as a width of a wall-receiving gap of each of the plurality of tubular detachable nozzles.

* * * * *